United States Patent [19]

Lea et al.

[11] 3,935,690

[45] Feb. 3, 1976

[54] METHOD OF PACKAGING AND UNPACKAGING A SELF-INFLATING AIR MATTRESS

[76] Inventors: James M. Lea, 1207 NW. Culbertson Drive, Seattle, Wash. 98177; John D. Burroughs, 10468 Forest Ave. South, Seattle, Wash. 98178

[22] Filed: Dec. 10, 1974

[21] Appl. No.: 531,299

[52] U.S. Cl. ..... 53/24; 53/21 FW; 53/22 B

[51] Int. Cl.[2] ..... B65B 63/02

[58] Field of Search ..... 53/7, 12, 21 FW, 22 R; 53/22 B, 22 A, 79, 112 R, 112 B, 124 B

[56] References Cited

UNITED STATES PATENTS

| | | | |
|---|---|---|---|
| 3,458,966 | 8/1969 | Dunbar et al. | 53/24 |
| 3,611,524 | 10/1971 | Broyles | 53/22 B X |
| 3,641,726 | 2/1972 | Cassina | 53/22 A X |

*Primary Examiner*—Travis S. McGehee

*Attorney, Agent, or Firm*—Graybeal, Barnard, Uhlir & Hughes

[57] ABSTRACT

A method of packaging a self-inflating air mattress comprising an open cell foam core and an air impervious envelope. A plurality of mattresses are stacked intermittently between forming boards and evacuated. Each bag is then rolled up and placed in a flexible tubular container and the vacuum released on the mattress to provide a sung package. To remove the mattress, the container and mattress are compressed, the inflating valve closed, and the mattress slipped from the container.

10 Claims, 7 Drawing Figures

METHOD OF PACKAGING AND UNPACKAGING A SELF-INFLATING AIR MATTRESS

BACKGROUND OF THE INVENTION

1. Field of the Invention

The present invention relates to a method of packaging and unpackaging a self-inflating air mattress.

2. Description of the Prior Art

There are in the prior art self-inflating air mattresses, which are made up of a resilient, open cell foam core, enclosed in an air impervious envelope. In the normal process of stowing the air mattress, the inflating valve of the mattress is opened, and the mattress is rolled up in a manner to compress the foam core. After the mattress is rolled up into a relatively compact package, the inflating valve is closed so that the force of atmospheric air pressing on the evacuated mattress keeps the mattress in its compact rolled-up configuration. To inflate the air mattress, the valve is opened which permits atmospheric air to enter the mattress and equalize the pressure with the surrounding atmosphere. The resiliency of the foam that makes up the core of the mattress causes the mattress to unroll as air flows into the air mattress, so that the mattress self-inflates to its expanded or "inflated" configuration. To the best knowledge of the applicants herein, the packaging techniques supplied to such air mattresses and air mattresses in general have been the conventional methods of simply providing a package envelope adequate to enclose the air mattress in its collapsed condition. Under this condition the outside surface of the mattress becomes wrinkled and tends to form a loose roll.

SUMMARY OF THE INVENTION

The method of the present invention relates to packaging and unpackaging a self-inflating air mattress, made up of a resilient foam core and an air impervious envelope. To package the air mattress, the mattress is rolled up in an evacuated condition into a compact rolled-up configuration. The rolled-up mattress is then placed in a tubular container, while maintaining the mattress in its evacuated condition. Then the interior of the mattress is released to atmospheric pressure to cause the foam interior of the mattress to expand and cause the mattress to fit snugly and smoothly in the container.

In the preferred form of the present invention, the mattress is first pressed flat by means of a forming board and then evacuated by applying a vacuum pump to the inflating valve of the mattress. This permits the mattress to be evacuated while maintaining the surface portions of the mattress is a smooth condition, without wrinkles. In a production operation, a plurality of air mattresses is stacked intermittently with a plurality of such forming boards. The valve of each mattress is then closed to maintain the vacuum, and each mattress is rolled up into a compact roll. A preferred manner of inserting each rolled-up mattress into a tubular container is to place the mattress inside a locating cylinder upon which has been placed a tubular container. Then the container and air mattress are simultaneously moved axially away from the cylinder, and the valve of the air mattress opened to permit the air mattress to expand to engage the inside surface of the container. This greatly facilitates handling when a quite flexible plastic material is used for the container.

To unpackage the air mattress, the valve of the air mattress is opened, the air mattress is pressed downwardly, and the valve is again closed. In this condition, the air mattress can easily be slipped from the container.

This method of packaging significantly improves the appearance and sales appeal of the deflated mattress.

DESCRIPTION OF THE PREFERRED EMBODIMENT

Figure 1:
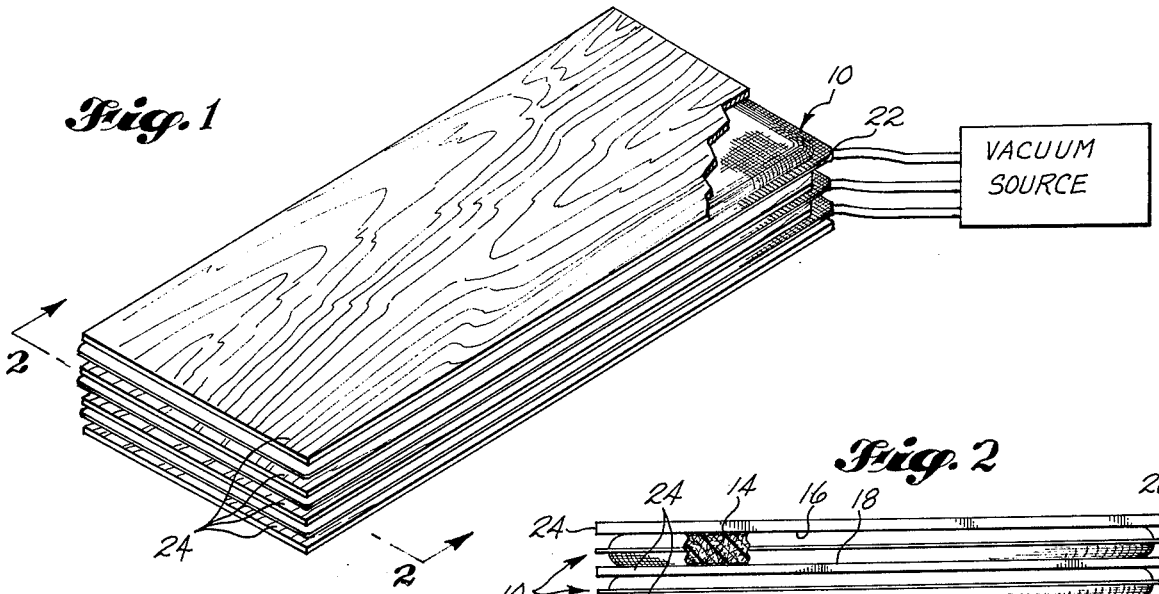
FIG. 1 is an isometric drawing illustrating the manner in which a plurality of air mattresses is stacked and evacuated.
Figure 2:
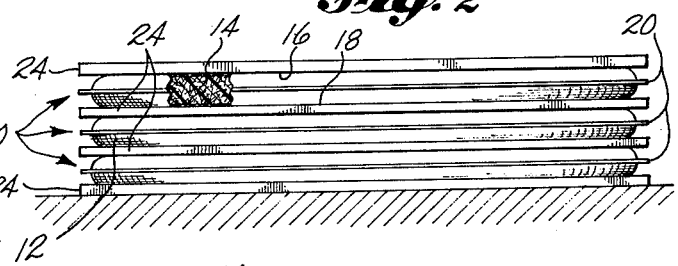
FIG. 2 is a sectional view taken along line 2—2 showing the air mattresses of FIG. 1 in their expanded or "inflated" condition.

The air mattress for which the packaging and unpackaging method of the present invention is particularly adapted is generally designated 10 and comprises an air impervious envelope 12, which encloses a compressible foam core, a portion of which is indicated at 14 in FIG. 2. In the particular configuration shown herein, the envelope 12 comprises upper and lower skins 16 and 18, respectively, bonded to one another in a "T" joint at 20 about the entire perimeter of the skins 16 and 18. Each air mattress 10 has at one corner thereof an inflating valve 22.

A quite desirable feature of such an air mattress is its self-inflating feature. To stow the mattress on a backpacking trip, the mattress is rolled up, with the valve 22 open, in a manner to compress the foam as the rolling operation progresses along the length of the mattress. When the rolling operation is completed, the valve 22 is closed, and the mattress maintains its rolled-up configuration, so that it can conveniently be stowed in a backpack. To inflate the mattress, the valve 22 is opened, thus permitting atmospheric air to pass through the valve 22 into the interior of the mattress 10. The resiliency of the foam core 14 causes the mattress to unroll to its expanded or "inflated" position. Thereafter, the valve 22 is closed to entrap the air in the mattress 10, which is then ready for use.

Figure 3:
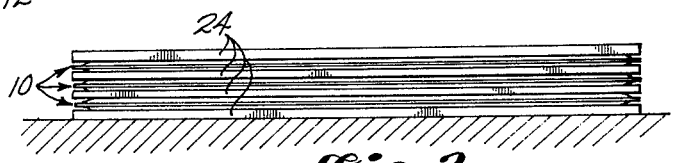
FIG. 3 is a sectional view taken along the same line as FIG. 2, but showing the air mattresses in their evacuated condition.

In the method of the present invention, a plurality of mattresses 10 is laid flat, one on top of the other, with a plurality of forming boards 24 placed between each mattress 10, and with one additional board 24 being place on top of the stack. This top board 24 should have sufficient weight to engage the upper surface of the top mattress with at least moderate pressure. A sheet of ⅝ inch plywood has been found to be adequate. These other forming boards 24 can be thinner rectangular sheets of plywood. In this embodiment, one corner of the interior boards is cut off diagonally to provide clearance for the valve housing. Next a vacuum pump is connected to each of the valves 22 of the mattresses 10 and the mattresses 10 are evacuated to the position shown in FIG. 3. By so evacuating the mattresses 10 while they are stacked in the forming boards, the upper and lower skins 16 and 18 of each mattress are maintained substantially smooth, without any wrinkles being formed thereon. It is believed that this is due to the frictional engagement of the upper and lower skins 16 and 18 with the board surfaces which press with moderate pressure against the air mattresses 10.

Figure 4:
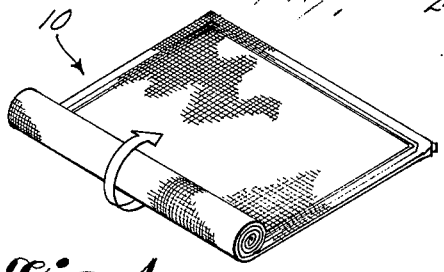
FIG. 4 is an isometric view illustrating the next step of rolling up the air mattress.

After the mattresses 10 have been evacuated, each of the valves 22 is closed and each mattress 10 is rolled up into a compact roll, as shown in FIG. 4. In its evacuated condition, the foam core 14 of the mattress 10 provides very little resistance to the rolling operation.

The rolled-up mattress is then placed in its container by use of a locating cylinder 26 mounted to suitable structure 28. The container 30 for the mattress 10 is simply an openended flexible tubular container, made of a material such as polyethylene. The tubular container 30, when maintained in a cylindrical configuration, has a diameter moderately larger than the outside diameter of the locating cylinder 26. The inside diameter of the locating cylinder 26 is moderately greater than the outside diameter of the rolled-up, evacuated mattress 10.

Figure 5:
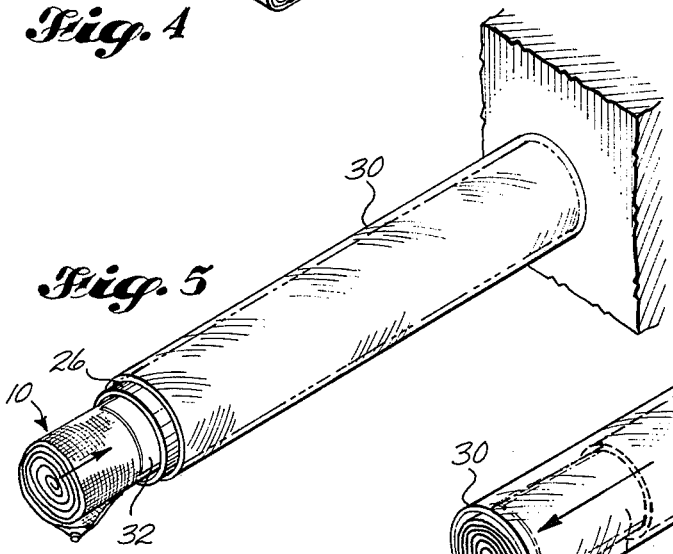
FIGS. 5 through 7 are isometric views illustrating the manner in which the air mattress and lables or brochures are placed in the container by means of aa locating sleeve.
Figure 6:
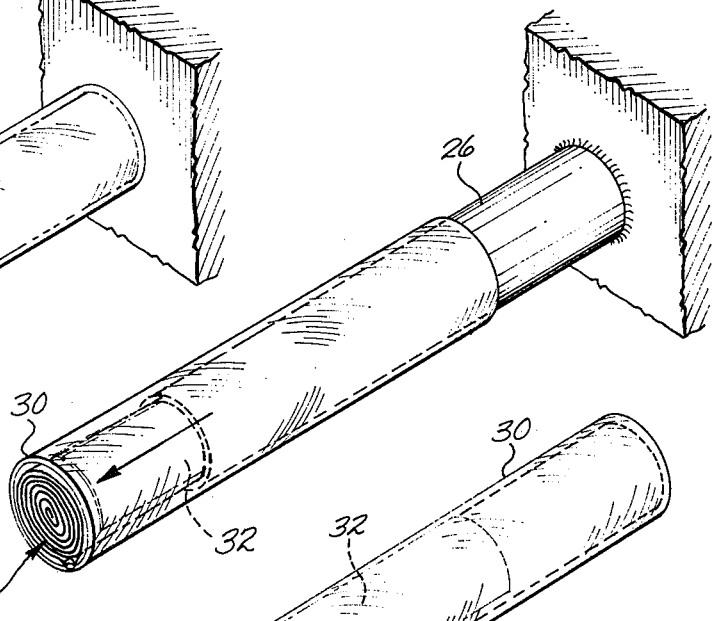

To accomplish the insertion of the mattress 10 into the container 30, first the container 30 is slipped onto the locating cylinder 26. Then the rolled-up, evacuated mattress 10 is inserted into the interior of the cylinder 26, as shown in FIG. 5. An information sheet, such as the label shown at 32 and/or a brochure, is accurately located on the exposed surface of the mattress 10, so that the outer end of the label 32 extends slightly beyond the end of the locating cylinder 26. Then, as shown in FIG. 6, the mattress 10 is cocked slightly to hold the label 32 in position against the edge of the cylinder 26. The container 30 is then slid over the mattress so that the ends of the container 30 line up with the ends of the mattress 10, after which the mattress 10 and container 30, with the label 32 therebetween, are grasped proximate the outside end of the cylinder 26 and moved axially from the locating cylinder 26, with the mattress 10 and label 32 and/or brochures thus being positioned inside the container 30. The valve 22 is then opened where the container 30 and mattress 10 are held in place, to permit atmospheric air to enter the interior of the mattress 10. As the mattress core 14 begins expanding the mattress 10 inside the package 30, the mattress expands in the container 30 until it snugly engages the inside surface of the container 30. In this configuration, the mattress 10 remains securely packaged inside the container 30, with the label 32 and/or brochures being frictionally held between the container 30 and mattress 10. With the container 30 being a transparent polyethylene material, the label 32 is clearly visible through the package and the outer surface of the package looks smooth and attractive.

Figure 7:
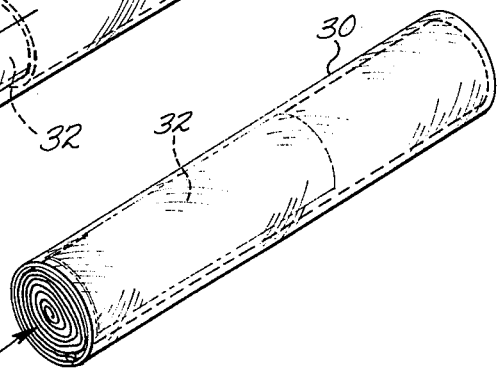

To unpackage the mattress 10 from its container 30, first, the person makes sure that the valve 22 is open, and a compressive force is then applied to the exterior of the container 30, as indicated by the arrows in FIG. 7. This can be done simply by the person pressing his hand against the top of the package 30 while the package 30 is resting on a table. After the compressive force is applied to push some of the air out of the interior of the mattress 10, the valve 22 is immediately closed. In this condition, the mattress 10 is moderately deflated from its packaged condition and it can easily be slipped out of the container 30. If desired, the package 30 can be used for repackaging the mattress 10 at a later time.

What is claimed is:

1. A method of packaging a self-inflating air mattress having an open cell foam core, an air impervious envelope, and an inflating valve, said method comprising:

a. rolling the air mattress in an evacuated condition into a compact rolled-up configuration, b. placing said rolled-up mattress in a tubular container, while maintaining its evacuated condition, and c. releasing the interior of the mattress to atmospheric pressure to cause the mattress to expand moderately to fit snugly in the container.

2. The method as recited in claim 1, wherein prior to rolling up the air mattress, the mattress is pressed with at least moderate pressure in a generally planar, flattened configuration, and a vacuum applied to the mattress while in such configuration.

3. The method as recited in claim 2, wherein said mattress is maintained in its planar, flattened configuration by laying said mattress under a forming board.

4. The method as recited in claim 3, wherein a plurality of mattresses is laid in a stack, with forming boards positioned intermittently between said mattresses.

5. The method as recited in claim 1, wherein said rolled-up mattress is placed in said container by placing the mattress in a locating cylinder and placing the container around the locating cylinder, and then simultaneously removing the rolled-up mattress and the container axially relative to the cylinder so that the mattress remains in the container.

6. The method as recited in claim 5, wherein an information sheet is placed on the exterior of said rolled-up mattress and inserted with the mattress into the locating cylinder, and withdrawn from the mattress from the locating cylinder so as to be positioned between the mattress and the container.

7. The method as recited in claim 1, wherein:

a. prior to rolling up the air mattress, the mattress is pressed with at least moderate pressure in a generally planar, flattened configuration, and a vacuum applied to the mattress while in such configuration; and b. said rolled-up mattress is placed in said container by placing the mattress in a locating cylinder and placing the package around the locating cylinder, and then simultaneously removing the rolled-up mattress and the package axially relative to the cylinder so that the mattress remains in the container.

8. The method as recited in claim 1, wherein a plurality of said air mattresses is positioned in a stack in a planar, flattened configuration, with forming boards placed intermittently between said mattresses, a vacuum is then applied to said mattresses and the valves of said mattresses closed, after which said mattresses are each rolled into a compact, rolled-up configuration, said method further comprising positioning each of said rolled-up mattresses into a locating cylinder, and placing said tubular container around said locating cylinder, after which said mattress and said container are simultaneously removed axially relative to the cylinder so that the mattress remains in the cylinder.

9. The method as recited in claim 1, further comprising additionally the removal of said air mattress from said container, said removal being accomplished by:

a. applying a compressive force to the packaged air mattress, with the valve of the air mattress being opened, so that air is pushed from the interior of the air mattress, b. then closing said valve, and c. removing the mattress axially from said tubular container.

10. A method of removing a self-inflating air mattress, having an open cell foam core, from a tubular container, where the air mattress has a snug fit in said container so as to be in frictional engagement therewith, said method comprising:

a. applying a compressive force to the packaged air mattress, with the valve of the air mattress being opened, so that air is pushed from the interior of the air mattress, b. then closing the valve, and c. removing the mattress axially from said tubular container.

* * * * *